United States Patent [19]

Yasinsky et al.

[11] 4,296,793

[45] Oct. 27, 1981

[54] REFRACTORY SUSPENSION FOR MAKING FOUNDRY MOULDS

[76] Inventors: Konstantin K. Yasinsky, ulitsa Spartakovskaya, 18, kv. 52; Sergei G. Glazunov, Leninsky prospekt, 41, kv. 62, both of Moscow; Jury N. Ross, ulitsa Patrioticheskaya, 74, kv. 36; Igor D. Bykov, ulitsa Turgeneva, 44, kv. 6, both of Zaporozhie, all of U.S.S.R.

[21] Appl. No.: 37,839

[22] Filed: May 10, 1979

Related U.S. Application Data

[63] Continuation of Ser. No. 835,689, Sep. 22, 1977, abandoned.

[51] Int. Cl.[3] ..... B28B 7/36

[52] U.S. Cl. ..... 164/24; 164/35; 164/527; 260/38; 260/DIG. 40

[58] Field of Search ..... 106/38.2; 260/DIG. 40, 260/38; 164/43, 24, 35

[56] References Cited

U.S. PATENT DOCUMENTS

| | | | |
|---|---|---|---|
| 2,895,936 | 7/1959 | Archer et al. | 260/DIG. 40 |
| 3,389,743 | 6/1968 | Morozov et al. | 164/43 |
| 3,644,274 | 2/1972 | Maurukas | 260/DIG. 40 |
| 3,725,333 | 4/1973 | Adkins et al. | 260/DIG. 40 |
| 4,028,271 | 6/1977 | Schaidle et al. | 260/38 |

*Primary Examiner*—Lorenzo B. Hayes

*Attorney, Agent, or Firm*—McAulay, Fields, Fisher, Goldstein & Nissen

[57] ABSTRACT

A refractory suspension comprising (parts by weight): coke, 10–60; powdered metallic titanium or/and zirconium, +0.3–5.0; resol resins, 5–50; a hardener, such as an inorganic acid, 2–30; an organic solvent, 20–60.

The proposed suspension allows making foundry moulds exhibiting a higher strength. The castings produced in said foundry moulds are superior in accuracy by 2 classes, according to the USSR classification, to those obtained by the prior-art methods.

9 Claims, No Drawings

REFRACTORY SUSPENSION FOR MAKING FOUNDRY MOULDS

This is a continuation of applicants' earlier patent application Ser. No. 835,689 filed Sept. 22, 1977 now abandoned for "REFRACTORY SUSPENSION FOR MAKING FOUNDRY MOULDS".

The present invention relates to a refractory suspension for making lost wax foundry moulds for casting pieces of chemically-active metals.

FIELD OF THE INVENTION

The herein-proposed suspension for making lost wax moulds can find extensive application for producing precision castings of chemically-active metals, say, titanium, in numerous branches of industry. But both said suspension and the moulds produced thereof may prove to be most advantageous in aircraft and rocket engineering as well as in mechanical engineering for manufacturing intricate pieces: brackets, reducers, T-pipes, sleeves, turbine blade wheels, casing members and gas-turbine and jet engine blades. As for shipbuilding, the need for using said suspension is governed by the possibility of producing cast members of propellers, their blades, cutoff fittings, pump and fan bodies.

In chemical machine-building the suspension finds use for casting gate and gate valve members, T-pieces, casing and cutoff fittings, pump bodies and various turbine and fan casings.

In watch and medical industries as well as in jewelry trade the proposed suspension can be particularly useful for making moulds for casting fine precision pieces—watch cases, bracelets, jewelry of various kinds, art castings, medical instruments, fasteners for treating bone fractures, making ankle and hip joints.

BACKGROUND OF THE INVENTION

At present there is known in the art a multitude of refractory suspensions adapted for making graphite lost wax moulds for casting, e.g., titanium pieces.

The process of making said foundry moulds is conducted by dipping wax patterns into a prepared suspension which is followed by dusting a graphite powder thereon. On applying each next layer to said wax pattern it is dried at a temperature of 28°-30° C. for 2.5 hours. The pattern is thus coated with 7-8 layers of graphite whereupon the wax is melted out in a steam bath. The moulds released from the wax patterns are subjected to curing by heating them to a temperature varying in the range between 1300° and 1350° C. and holding at this temperature for 4 hours.

The baked moulds are placed in a vacuum skull furnace and filled with molten metal. The thus produced castings are discharged from the furnace and released from the moulds whereupon they are cut off the gate system and heads. All these operations completed the castings are subjected to sandblasting.

For example there is known in the art a graphite-resin suspension comprising a filler—a graphite powder, a binder-phenol-formaldehyde resin, hydrochloric acid and an esteraldehyde fraction, the ratio of said suspension constituents being respectively as follows (parts by weight): 37-44; 35-37; 3-4; 18-22.

The disadvantage of said suspension resides in that in making moulds thereof use is made of a graphite powder as a filler, which enhances the heat conductivity of said moulds, a feature adversely affecting the mould-filling ability when producing thin-section parts and giving rise to cold shuts that are liable to appear on the surface of said castings. Moreover the moulds made on the basis of said suspension cannot be reclaimed insofar as the recurrent use of the powders obtained by comminuting used moulds causes a greater scatter in the mould geometric dimensions with the ensuing deterioration of casting accuracy.

There is likewise known in the art a refractory suspension for making casting moulds comprising the below-listed constituents taken in the following amounts (percent by weight):

a filler—a graphite powder which is the basic component of said suspension, and metallic powdered titanium, 0.8-2.5;
a binder—phenol baryta resin, 20-25;
a hardener—a mixture of sulphonaphtenic acids, the so-called "Petrov's contact catalyst", 7-9;
an organic solvent—alcohol, 30-36.

The disadvantage peculiar to said suspension lies in a higher collapsibility of the moulds produced thereof, which is also liable to cause casting rejects. The use of a graphite powder as a filler enhances the heat conductivity of the moulds decreasing thereby their filling ability which is of paramount importance in casting thin-section pieces with a wall thickness of 1.5 mm and up to 30 mm long which is actually impractical in said mould. The moulds produced from said suspension are almost unsuitable for reclamation, the reclaimed powders not allowing precision castings to be produced therein.

It is an object of the present invention to overcome the above disadvantages.

The principal object of the invention is to provide a refractory suspension whose application for making foundry moulds would make it possible to enhance the geometric accuracy of cast pieces.

Another object of the invention is the provision of a refractory suspension which would allow enhancing the mechanical strength of the foundry moulds produced on the basis of said suspension.

Still another object of the invention is the provision of a refractory suspension whose application for making foundry moulds would make it possible to obtain cast pieces with thinner sections and a higher surface finish.

Yet another object of the invention is to provide a refractory suspension for making foundry moulds which would enable shell moulds to be recurrently reclaimed after filling them with metal without impairing the quality of the moulds produced of said reclaimed powder.

SUMMARY OF THE INVENTION

Said objects are achieved by providing a refractory suspension for making lost wax foundry moulds for casting pieces of chemically-active metals, said refractory suspension comprising a binder which is resol resin, a hardener, a filler and an organic solvent, the composition of said suspension incorporating according to the invention, coke and metallic powdered titanium or/and zirconium as said filler and an organic or inorganic acids as the hardener, the ratio of said constituents being as follows (parts by weight):

-continued

| | |
|---|---|
| powdered titanium or/and zirconium | 0.3–5.0 |
| resol resin or a mixture thereof | 5–50 |
| organic solvent | 20–60 |
| hardner | 2–30. |

The application of said coke-resin suspension for producing lost wax moulds by making use of powdered coke as a parting dust enabled the shell strength of a thus produced mould to be increased 1.5 times as against that of the moulds made from the prior-art suspension, i.e. from 12 to 17–18 kgf/cm$^2$, geometric accuracy spread to be decreased and casting accuracy to be enhanced by 2 classes, according to the USSR classification (by 100 mm ±0.3–0.5 mm instead of ±0.6–0.8 mm).

The presence of said constituents in the composition of the proposed suspension as well as the use of coke as a parting dust decreases several times the heat conductivity of the mould which provides for a higher mould-filling ability securing thereby the manufacture of thin-section castings of intricate geometry and enhancing at the same time their quality by eliminating cold shuts and other defects.

The suspension composition incorporating less scarce materials, it is less expensive and can find extensive application in various branches of industry.

When producing moulds of the proposed suspension filler requirements are decreased by 50–60% owing to the possibility of recurrent reclaiming of the used moulds after casting without impairing the quality of both the reclaimed mould and castings produced therein and diminishing as a result the production cost of the moulding material by 25–30%.

According to the present invention, it is expedient that the proposed suspension comprise phenolic resin as a resol resin binder.

Moreover it is sound practice that according to the invention furan resin be used as said resol resin binder.

It was found that the introduction of resol resins, e.g., phenolic and furan, characterized by a high coke yield into the composition of the proposed refractory suspension enabled an increase in the strength of the produced foundry moulds to be attained, their geometric stability enhanced and mould collapsibility reduced.

For providing a refractory suspension adapted for making foundry moulds, it is advisable that the composition of said suspension incorporate hydrochloric, sulphuric or benzenesulphonic acids as a hardener, said acids featuring the highest reactivity for setting-up a polymer.

According to the present invention, it is good practice that the proposed suspension comprise alcohols or their mixtures as said organic solvents.

The introduction of said alcohols into the composition of the suspension of the invention renders the long-term storage of a prepared suspension possible prior to its use.

Further objects and advantages of the invention will become apparent from the following detailed description of a refractory suspension for making foundry moulds and illustrative examples of the embodiment of the proposed suspensions.

DETAILED DESCRIPTION OF THE INVENTION

The use of 10–60 parts by weight of powdered oil, pitch, coal or charcoal coke in the proposed suspension allowed imparting a foundry mould the requisite strength, eliminating its collapsibility, providing better filling of said mould with molten metal owing to a lower heat conductivity of the coke which amounted to 6.2 W/m·deg as against that of graphite which was equal to 129 W/m·deg. A reduced heat conductivity enhances the mould-filling ability which makes it possible to produce thin-section pieces with a wall thickness of 1.5 mm and up to 30 mm long, eliminate surface defects on the castings, such as cold shuts, and improve the quality of said castings.

As the moulds are being subjected to curing both the resin and hardener comprised in the suspension pass into coke and since the latter is employed as a filler, the linear expansion factor of the two materials thus produced will be the same specifying thereby a stable shrinkage of the mould and a higher accuracy of the castings.

The use of said suspension with a coke filler for making coke moulds allows reclaiming the moulds completely upon filling them with metal, producing thus the powdered coke required for their recurrent application in said suspension and for dusting use.

We have also found that with the coke content less than 10 parts by weight the produced refractory suspension will exhibit a low binding power when making moulds and dusting them with powdered coke, and the mould-making operation will require much time. With the coke content exceeding 60 parts by weight a thick slurry is obtained, the process of applying the next layers to the mould being therefore complicated and the geometry of the produced mould disturbed.

As for the second constituent, a filler, we propose to use metallic titanium or/and zirconium powders varying in amount from 0.3 to 5.0 parts by weight which will contribute to producing foundry moulds more inert to the molten metal. This is attributable to the formation of carbides of said metals (during curing) in the mould per se and on its surface in particular, said carbides decreasing molten metal/mould interaction and enhancing at the same time the mould strength by 1.5–2.0 kgf/cm$^2$. However a higher content of said metallic powders exceeding 5.0 parts by weight results in a lower strength and higher collapsibility of the mould (which is caused in our opinion by disturbed bonds between the binder-resin and the coke filler).

The herein-proposed suspension contains from 5 to 50 parts by weight of the binder-resol resins.

The present invention envisages the possibility of using, say, the following resins: phenol-formaldehyde, phenol-furfural, phenol-furfuryl, phenol-furfural-formaldehyde, phenol-cresol-furfural, furfural-acetone, furfural-aldehyde, furan, carbamide-furan phenolic alcohols, carbamide-formaldehyde, carbamide-furfural, carbamide-formaldehyde-furfural, resorcinol, resorcinol-formaldehyde; resorcinol-phenol-formaldehyde, resorcinol-phenol-furfural; melamine-formaldehyde, melamine-phenol-formaldehyde, amine-formaldehyde, amine-phenol-formaldehyde and epoxy resins.

On being introduced into the composition of the proposed suspension as a binder said resins or a mixture thereof assure due to their coking during curing a requisite strength of the moulds varying in the range of 17–25 kgf/cm$^2$. It does not affect a minimum scattering of the mould geometric dimensions, and the castings are held within closer tolerances of up to ±0.3–0.5 mm per $\phi$100 mm.

However when the contents of said resins in the suspension drop below 5 parts by weight, the strength of the moulds produced thereof deteriorates, their collapsibility increases and the moulds fail as they are being filled with molten metal. Where the resin content in the suspension increases, say, in excess of 50 parts by weight, the process of extracting castings out of the moulds produced from said suspension is complicated due to said excessive strength of the moulds; moreover the stability of the mould geometric dimensions is disturbed during baking which adversely affects the accuracy of the produced castings.

As regards the hardeners, use is made in the proposed suspension of various organic and inorganic acids introduced into the suspension composition in amounts ranging from 2 to 30 parts by weight, such as: hydrochloric, sulphuric, benzenesulphonic, paratoluenesulphonic, orthotoluenesulphonic, orthophosphoric, acetic, boric, oxalic, formic acids, paratoluenesulphochloride and a mixture of sulphonaphtenic acids ("Petrov's contact catalyst").

As catalysts said compounds assist in rapid hardening of the binders contained in the suspension, ensuring a stable mould shrinkage during moulding, which enables a required shrinkage of said mould and a preset casting accuracy to be attained.

A hardener content of less than 2 parts by weight extends the setting-up period of the resins comprised in the proposed suspension, whereas with the resin contents exceeding 30 parts by weight polymerization of said resins proceeds at an extremely high pace, the process of making moulds of said suspension being thereby actually unfeasible.

The solvents employed in the suspension vary in amount from 20 to 60 parts by weight and are adapted for diluting the resin or/and their mixtures to a required density (with due account of the preset viscosity) so as to ensure a proper serviceability of the proposed suspension when making moulds. As for the solvents, use can be made of such alcohols as, say, methyl, ethyl, propyl, isopropyl butyl, isobutyl, amyl alcohols and their isomers: esters, such as ethyl, butyl, propyl and amyl acetates; the mixtures of aromatic hydrocarbons, such as benzol; toluene, xylene, with alcohols; glycol ethers and mixtures thereof, such as monomethyl ethylene glycol, monoethyl ethylene glycol, monoisopropyl ethylene glycol, monobutyl ethylene glycol ethers and their mixtures with alcohols as well as acetone.

By varying the solvent content within the above-specified range it is possible to adjust a preset density and viscosity of the proposed suspension.

Thus, the combination of said components: coke, resins, hardeners and solvents employed for preparing the proposed suspension, secures the production of foundry moulds featuring a stable shrinkage and a requisite strength varying in the range between 17 and 25 $kgf/cm^2$. At the same time the use of said suspension with a preset weight ratio of its constituents for making foundry moulds enables the mould-filling ability to be enhanced and castings with thinner walls and a good surface finish without any cold shuts whatsoever to be obtained, said qualities being secured due to a lower heat conductivity of the coke moulds as compared with graphite ones.

Moreover using the proposed suspension comprising said constituents for making coke-based foundry moulds affords the possibility of repeated reclaiming of said moulds on filling them with molten metal, without impairing the quality of reclaimed moulds produced from a reclaimed powder.

On being employed for making casting moulds said suspension diminishes the scattering of their geometric dimensions and enables cast pieces to be produced with closer tolerances that are held within ±0.3–0.5 mm per $\phi$100 mm.

Finally the use of the herein-proposed refractory suspension for making lost wax foundry moulds enables the heat conductivity of said moulds to be reduced, this resulting in a higher mould-filling ability and producing thin-section castings with a wall thickness of up to 1.5 mm. As for the better surface quality of the produced castings, it is obtainable due to the elimination of cold shuts, and other defects related to the heat conductivity of the mould. A less scarce material—coke, used in said suspension as a filler instead of graphite, brings down its cost and provides the possibility of recurrent reclaiming of the used coke moulds for producing parting dusts, the consumption of the moulding materials (powdered coke required for producing both the suspension and moulds) decreasing thereby by 50–60% with the ensuing reduction in the cost of said materials by another 25–30%. The recurrent reclaiming of the used moulds (shells) for producing powders does not affect the quality of both the reclaimed moulds and castings produced therein.

In view of said reduction in the cost of producing foundry moulds which is rendered possible by using less scarce inexpensive materials and reclaiming the moulds the herein-proposed suspension may find wide acceptance for making coke moulds in various branches of inductry where a need arises for casting such metals as titanium, zirconium and the like. Given hereinbelow is the technique of preparing said suspension and making coke moulds thereof, said technique being similar for all suspensions.

EXAMPLE 1

For preparing a refractory suspension 26 parts by weight of phenol-formaldehyde resin are dissolved in 36 parts by weight of methyl alcohol, whereupon 0.8 parts of powdered zirconium and 28 parts by weight of powdered coal coke are introduced into the produced composition, all components are thoroughly stirred and the last constituent—a hardener which is concentrated hydrochloric acid taken in an amount of 4 parts by weight, is added to the suspension. After some more stirring the suspension is subjected to holding for 0.5–1.0 hour for removing air bubbles which may be entrapped therein.

Foundry moulds were produced by dipping wax patterns in the thus prepared suspension, this being followed by dusting them with a coke powder. On applying each next layer to the wax pattern it was subjected to drying in special driers at a temperature varying in the range between 28° and 30° C. for 2.5 hours. The pattern was thus coated with 7–8 layers of coke whereupon the wax was melted out in a steam bath, moulding composition or in water acidified by adding 3% hydrochloric acid thereto.

On being released from the wax composition the moulds were subjected to curing by heating them to a temperature ranging within 1300°–1350° C. and holding at this temperature for 4 hours.

The baked moulds are placed in a vacuum skull furnace and filled with molten metal. Produced castings are discharged from the furnace, extracted out of the moulds and cut off the gate system and heads. All operations completed the cast pieces are subjected to sandblasting and checked for quality and accuracy.

The accuracy of the castings produced by using coke moulds made from said suspension varies within ±0.3–0.38 mm per $\phi$100 mm and their strength is of the order of 20 kgf/cm$^2$. The castings feature a good surface finish without any cold shuts whatsoever.

EXAMPLE 2

For preparing a refractory suspension 31 parts by weight of furan resin are dissolved in 40 parts by weight of isobutyl alcohol whereupon 1.8 parts by weight of powdered titanium and 36 parts by weight of powdered oil coke are introduced into the produced solution. All components are carefully stirred, whereafter a hardener—3 parts by weight of concentrated sulphuric acid—is introduced into the thus obtained suspension. This is followed by some more stirring and the suspension is held for 0.5–1.0 hour for removing air bubbles which may be entrapped therein.

The thus produced suspension is employed for making a foundry moulds by using the technique described in Example 1 and then a casting per se. The produced casting mould exhibits a good strength amounting to 22 kgf/cm$^2$ and an accuracy that is held within ±0.4–0.45 mm per $\phi$100 mm.

EXAMPLE 3

For preparing a refractory suspension 10 parts by weight of resorcinol and 25 parts by weight of furfural aldehyde resins are dissolved in 38 parts by weight of isopropyl alcohol, whereupon 40 parts by weight of titanium and 42 parts by weight of coal coke powders are introduced into the obtained solution. All components are thoroughly mixed and a hardener—7.0 parts by weight of paratoluenesulphonic acid—is introduced into the thus produced suspension. The latter is stirred again and held for 0.5–1.0 hour for removing air bubbles which may be entrapped into the suspension.

The thus produced suspension is employed for making (using the technique quoted in Example 1) a foundry mould featuring a strength of 23.5 kgf/cm$^2$. Said high strength inherent in the foundry moulds allows using more thin-walled moulds and producing sound castings accurate within ±0.48 mm per $\phi$100 mm.

EXAMPLE 4

To produce a refractory suspension 15 parts by weight of phenol-furan resin are dissolved in 57 parts by weight of ethyl alcohol whereupon 0.3 parts by weight of titanium and 60 parts by weight of pitch coke powders are introduced into the obtained solution. All components are thoroughly stirred and a hardener—13 parts by weight of paratoluenesulphochloride—is introduced into the thus produced suspension. After some more stirring the suspension is held for 0.5–1.0 hour for removing air bubbles which may be entrapped therein.

The thus produced suspension is employed for making (using the technique described in Example 1) a foundry mould and then a casting featuring an adequate surface finish and an accuracy of ±0.41 mm per $\phi$100 mm.

EXAMPLE 5

For preparing a refractory suspension 42 parts by weight of furfural-aldehyde resin are dissolved in 28 parts by weight of amyl alcohol, whereupon 5.0 parts by weight of zirconium and 18 parts by weight of pitch coke powders are introduced into the obtained solution. All components are carefully stirred and a hardener—19 parts by weight of paratoluenesulphonic acid—is introduced into the thus produced suspension. The latter is subjected to some more stirring and held for 0.5–1.0 hour for removing air bubbles which may be entrapped therein.

The thus produced suspension is employed for making (using the technique described in Example 1) a foundry mould featuring an adequate heat conductivity and an enhanced chemical resistance to molten titanium and other high-melting point metals. The accuracy of the castings produced in said mould does not exceed ±0.5 mm per $\phi$100 mm.

EXAMPLE 6

For preparing a refractory suspension 24 parts by weight of furan and 8 parts by weight of phenol-furfuryl resins are dissolved in 40 parts by weight of butyl alcohol, whereupon 1.2 parts by weight of titanium and 32 parts by weight of pitch coke powders are introduced in the produced solution. All components are thoroughly stirred and a hardener—6 parts by weight of benzenesulphonic acid—is introduced into the thus produced suspension. After some more stirring the suspension is held for 0.5–1.0 hour for removing air bubbles which may get into the suspension.

The thus produced suspension is employed for making a foundry mould by using the technique described in Example 1, said mould featuring a high strength amounting to 23 kgf/cm$^2$ with the castings having an accuracy of ±0.35 mm per $\phi$100 mm.

EXAMPLE 7

For preparing a refractory suspension 3 parts by weight of resorcinol and 11 parts by weight of phenol-furfural resins are dissolved in 60 parts by weight of isobutyl alcohol whereupon 2.5 parts by weight of zirconium and 36 parts by weight of oil coke powders are introduced into the produced solution. All components are thoroughly stirred and a hardener—3 parts by weight of orthophosphoric acid are introduced into the thus produced suspension. After some more stirring the suspension is held for 0.5–1.0 hour to remove air bubbles that may be entrapped therein.

The thus produced suspension which can withstand long-term storage without hardening is employed for making a foundry mould, using the technique described in Example 1, said foundry mould exhibiting a strength of 25 kgf/cm$^2$ which makes it possible to produce castings featuring a higher accuracy of ±0.35 mm per $\phi$100 mm.

EXAMPLE 8

For preparing a refractory suspension 48 parts by weight of carbamide-furan resin are dissolved in 26 parts by weight of amyl acetate whereupon 3.2 parts by weight of titanium and 52 parts by weight of coal coke powders are introduced into the obtained solution. All components are thoroughly stirred and a hardener—14 parts by weight of boric acid—is introduced into the thus produced suspension. After some more stirring the suspension is held for 0.5–1.0 hour for removing air bubbles entrapped therein.

The thus produced suspension is employed using the technique described in Example 1 for making a foundry mould, the suspension hardening rapidly on said mould as it is being produced. The produced casting exhibits good surface finish, as for the mould strength it is at the level of 20–21 kgf/cm$^2$.

EXAMPLE 9

For preparing a refractory suspension 40 parts by weight of furfural-acetone resin are dissolved in 17 parts by weight of acetone whereupon 1.0 part by weight of titanium and 29 parts by weight of coal coke powders are introduced into the obtained solution. All components are thoroughly stirred and a hardener—15 parts by weight of acetic acid—is introduced into the thus produced suspension. The latter is stirred once more and held for 0.5–1.0 hour to remove air bubbles which may be entrapped therein.

The thus produced suspension is employed using the technique described in Example 1 for making a foundry mould, said suspension allowing a rapidly-drying mould to be obtained. The strength of the produced casting mould amounts to 17 kgf/cm$^2$ and casting accuracy is held within ±0.5 mm per $\phi$100 mm.

EXAMPLE 10

For preparing a refractory suspension 28 parts by weight of carbamide-furfural resin are dissolved in a mixture of solvents comprising 16 parts by weight of butyl acetate and 7 parts by weight of butyl alcohol, whereupon 4.5 parts by weight of a mixture containing titanium and zirconium powders and 10 parts by weight of an oil coke powder are introduced into the obtained solution. All components are carefully stirred and a hardener—12 parts by weight of a mixture of sulphonaphtenic acids ("Petrov's contact catalyst")—is introduced into the thus produced suspension. After some more stirring the suspension is held for 0.5–1.0 hour for removing air bubbles which may be entrapped therein.

The thus produced suspension is employed using the technique described in Example 1 for making a foundry mould exhibiting a strength of 18 kgf/cm$^2$, the accuracy of the produced casting being equal to ±0.46 mm per $\phi$100 mm.

EXAMPLE 11

For preparing a refractory suspension 20 parts by weight of melamine-phenol-formaldehyde resin and 12 parts by weight of phenolic alcohol are dissolved in 32 parts by weight of monoethyl ethylene glycol ether whereupon 3.2 parts by weight of a titanium powder and 31 parts by weight of a coal coke powder are introduced into the obtained solution. All components are thoroughly stirred and a hardener—7 parts by weight of orthotoluenesulphonic acid—is introduced into the thus produced suspension. The latter is given some more stirring and held for 0.5–1.0 hour to remove air bubbles which may be entrapped therein.

The thus produced suspension is employed under the technique described in Example 1 for making a foundry mould exhibiting a strength of 21 kgf/cm$^2$. As for the produced castings, their accuracy is held within ±0.5 mm per $\phi$100 mm.

EXAMPLE 12

For preparing a refractory suspension 18 parts by weight of amine-formaldehyde and 8 parts by weight of epoxy resins are dissolved in a mixture of aromatic hydrocarbons and alcohols (xylene+butyl alcohol) taken in an amount of 32 parts by weight whereupon 2.8 parts by weight of a zirconium and 31 parts by weight of pitch coke powders are introduced into the obtained solution. All components are thoroughly stirred and a hardener—11 parts by weight of formic acid—is introduced into the thus produced suspension. After some more stirring the suspension is held for 0.5–1.0 hour for removing air bubbles entrapped therein.

The thus produced suspension is employed using the technique described in Example 1 for making a foundry mould exhibiting a strength of 19 kgf/cm$^2$. The castings have an accuracy of ±0.4 mm per $\phi$100 mm.

What we claim is:

1. A refractory suspension for making lost wax foundry moulds for casting pieces of chemically-active metals, the ratio of suspension constituents consisting essentially of as follows (parts by weight): coke, 10–60; a powdered metal selected from the group consisting of titanium, zirconium and a mixture thereof, 0.3–5.0; resol resins, 5–50; a hardener selected from the group consisting of an organic and inorganic acids, 2–30; an organic solvent, 20–60.

2. A refractory suspension of claim 1, containing phenol resin as said resol resin.

3. A refractory suspension of claim 1, containing furan resin as said resol resin.

4. A refractory suspension of claim 1, containing hydrochloric acid as said hardener.

5. A refractory suspension of claim 1, containing sulphuric acid as said hardener.

6. A refractory suspension of claim 1, containing benzene-sulphonic acid as said hardener.

7. A refractory suspension of claim 1, containing alcohols or mixtures thereof as said organic solvent.

8. A method for making lost wax foundry moulds comprising the steps of:

(a) forming a suspension consisting essentially, in percent by weight, of coke, 10–60; a powdered metal selected from the group consisting of titanium, zirconium, and mixtures thereof, 0.3–5.0; resol resins, 5–50; a hardener selected from the group consisting of organic and inorganic acids, 2–30; and an organic solvent, 20–60;

(b) providing a wax pattern;

(c) coating the pattern with the suspension at least four times, and sprinkling said pattern with powdered coke;

(d) drying the coating to obtain a rigid mould;

(e) melting the wax pattern from its rigid mould; and (f) curing the mould by heating to about 1300°–1350° C.

9. The method of claim 8 wherein the coating of the pattern with the suspension is accomplished six to eight times.

* * * * *

UNITED STATES PATENT AND TRADEMARK OFFICE

CERTIFICATE OF CORRECTION

PATENT NO. : 4,296,793

DATED : October 27, 1981

INVENTOR(S) : Konstantin K. Yasinsky et al

It is certified that error appears in the above—identified patent and that said Letters Patent is hereby corrected as shown below:

In the Abstract, line 3 change "+0.3-5.0" to --0.3-5.0--

Column 3, line 25 change "incorporating" to --incorporates--

Column 6, line 33 change "inductry" to --industry--

Signed and Sealed this

*Thirtieth* Day of *March 1982*

[SEAL]

*Attest:*

GERALD J. MOSSINGHOFF

*Attesting Officer*

*Commissioner of Patents and Trademarks*